US005575619A

United States Patent [19]

Chen

[11] Patent Number: 5,575,619

[45] Date of Patent: Nov. 19, 1996

[54] COOLING FAN FOR MOTORS

[76] Inventor: Jui-Chih Chen, No. 3, Lane 25, Fu-An Street, Mei-Nong Town, Kauhsuing Hsien, Taiwan

[21] Appl. No.: 563,719

[22] Filed: Nov. 28, 1995

[51] Int. Cl.[6] ..... F04D 29/04

[52] U.S. Cl. ..... 415/175; 415/110

[58] Field of Search ..... 415/110, 111, 415/175

[56] References Cited

U.S. PATENT DOCUMENTS 5,013,224 5/1991 Liao ..... 416/100

5,362,201 11/1994 Uhrner et al. ..... 415/111

*Primary Examiner*—John T. Kwon

*Attorney, Agent, or Firm*—Pro-Techtor International

[57] ABSTRACT

Disclosed is a cooling fan for motors mainly includes a back cover formed with a through shaft holder and a front cover formed with a plug member and a rotary shaft projected from the plug member. Two bearings or copper bushings are disposed inside the shaft holder to together with an oil ring seal disposed at a front opening of the shaft holder to divide an inner space of the shaft holder into three oil chambers. The front cover is covered over the shaft holder with the plug member received in the front opening thereof and the rotary shaft extending through the oil ring seal and the two bearings and being held thereto by a washer put over a free end of the rotary shaft projected out of the second bearing. Lubricant or the like is filled into the oil chambers in the shaft holder from a back opening of the shaft holder and is stored therein by another oil ring seal disposed in the back opening. Rotational resistance of the rotary shaft, heat produced during such rotation, and power consumed for such rotation all are reduced with the above arrangements.

2 Claims, 4 Drawing Sheets

COOLING FAN FOR MOTORS

BACKGROUND OF THE INVENTION

The present invention relates to a cooling fan for motors, and more particularly to a cooling fan for motors in which two bearings or copper bushings and a closed shaft holder adapted for containing lubricant therein are provided, so that the cooling fan has reduced rotational resistance and less heat produced by the rotational friction, and, power consumption required by the cooling fan is also reduced.

FIG. 4 illustrates a conventional cooling fan for motors which mainly includes a back cover 1 having a shaft holder 11 provided at a central portion thereof. A bearing 3 is disposed in the shaft holder 11, a motor 9 is properly provided around an outer periphery of the shaft holder near a middle portion thereof with coils 91 wound about the outer surface of the shaft holder 11. When the motor 9 is turned on, a rotary shaft 23 extending into the shaft holder 11 and through the bearing 3 is rotated with the help of the bearing 3. The rotation of the rotary shaft 23 then drives a front cover 2 and blades 21 of the cooling fan to rotate.

Following drawbacks are found in the conventional cooling fan for motors having the above-described structure:

1. Since there is only one bearing 3 provided in the shaft holder 11, the rotary shaft 23 tends to rotate eccentrically and very possibly causes unstable rotation of the blades 21.

2. The rotary shaft 23 shall rotate at increased resistance when a part of lubricant in the shaft holder 11 is consumed and the only bearing 3 is worn out.

3. The increased resistance during the rotation of the rotary shaft 23 shall further increase the heat produced by the friction of shaft 23 with the bearing 3 and causes larger consumption of power.

It is therefore tried by the inventor to develop a cooling fan for motors to eliminate the above drawbacks existed in the conventional cooling fans.

SUMMARY OF THE INVENTION

A primary object of the present invention is to provide a cooling fan for motors which has dual bearings or copper bushings and adequate amount of lubricant provided inside the shaft holder so that the rotary shaft of the cooling fan can be lubricated without rotating eccentrically.

Another object of the present invention is to provide a cooling fan for motors which would avoid the consumption or drying of lubricant inside the shaft holder so that the rotary shaft can always rotate at low resistance and thereby produces less heat due to friction. The low resistance also reduces the consumption of power required by the motor.

BRIEF DESCRIPTION OF THE DRAWINGS

The other objects and the features and functions of the present invention can be best understood by referring to the following detailed description of the preferred embodiment and the accompanying drawings wherein.

DETAILED DESCRIPTION OF THE PREFERRED EMBODIMENT

Figure 1:
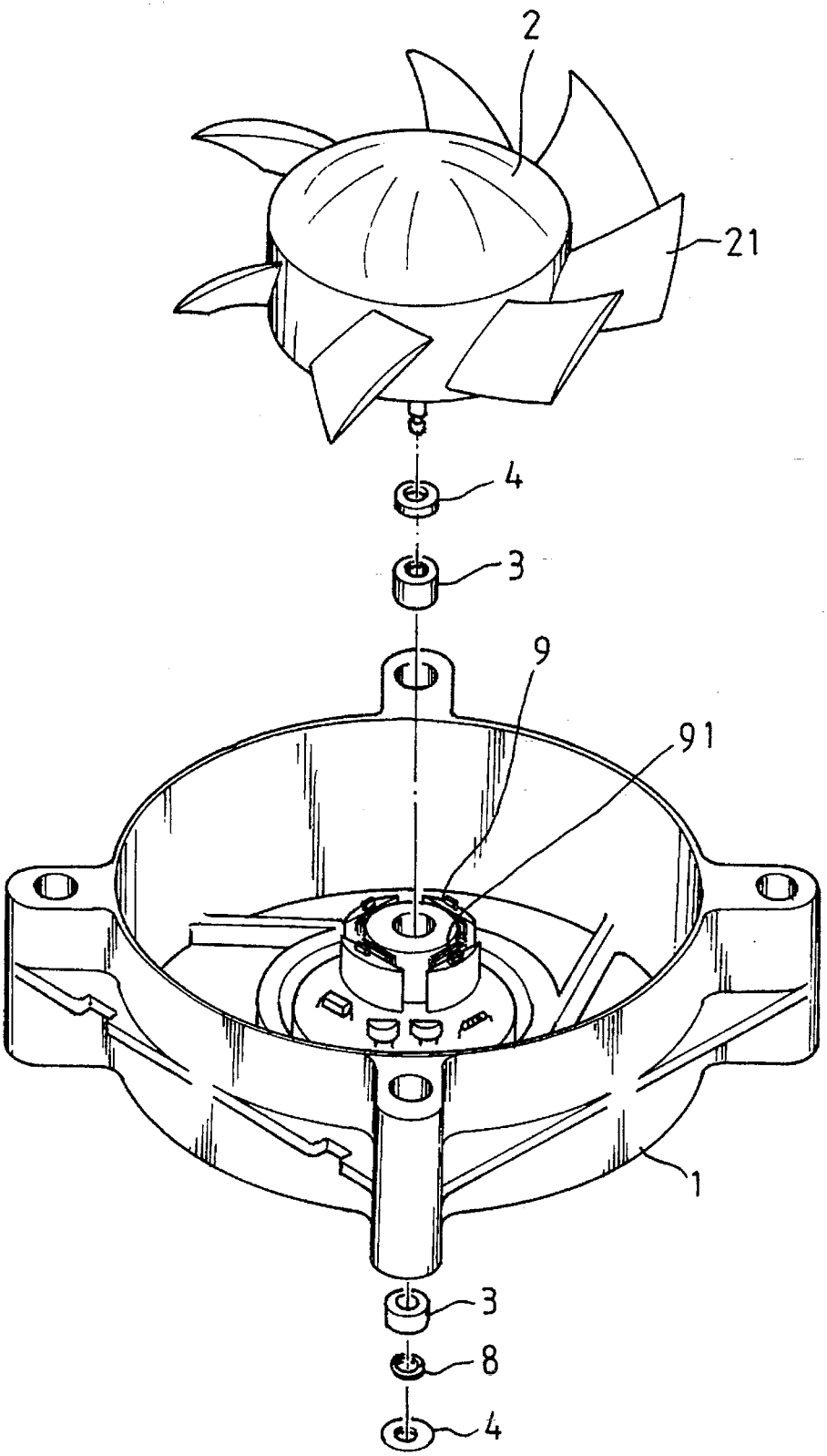
FIG. 1 is an exploded perspective of the present invention.
Figure 2:
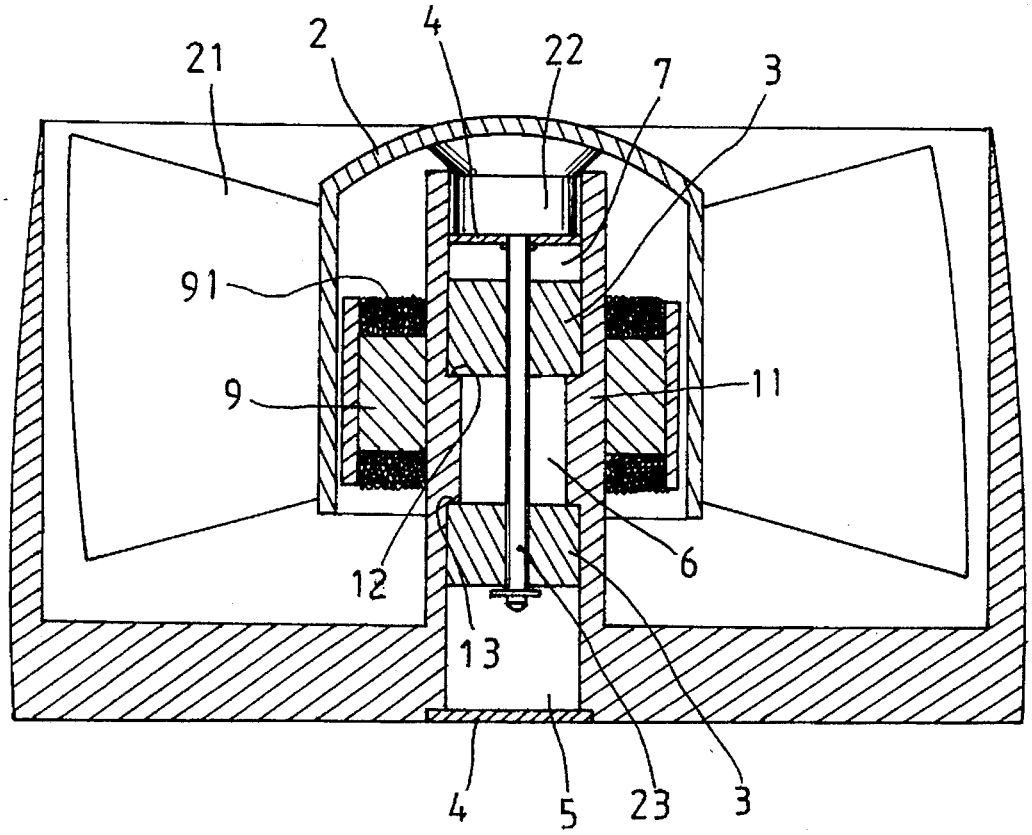
FIG. 2 is an assembled sectional view of the present invention.

Please refer to FIGS. 1 and 2 which are an exploded perspective and an assembled sectional view of the present invention, respectively. As shown in the drawings, the present invention mainly includes a back cover 1 formed with a through shaft holder 11 at a central portion thereof. The shaft holder 11 has a reduced inner diameter at its middle section and thereby forms a front and a back stepped surfaces 12, 13 at two ends of this diameter-reduced portion. A first and a second bearings 3 are fixedly positioned in the shaft holder 11 at each side of the reduced middle portion to respectively abut their one side against the stepped surfaces 12, 13 through high-frequency wave process. Alternatively, two copper bushings can be embedded in the shaft holder 11 at positions similar to those described for the bearings 3 before the shaft holder 11 is formed by injection molding. A first oil ring seal 4 is fixedly disposed near a front opening of the through shaft holder 11. A motor 9 is fixedly provided to an outer surface of the shaft holder 11 near a middle portion thereof with coils 91 wound about the outer surface of the shaft holder 11.

The first oil ring seal 4 and the two bearings 3 together divide a space defined by the shaft holders into three communicable oil chambers 7, 6, and 5 from a front side to a backside. A front cover 2 with integrally formed blades 21 is covered over the shaft holder 11 to house the same and the motor 9, such that a plug member 22 attached to an inner side of the front cover 2 is fitly engaged and received in the front opening of the shaft holder 11, while a rotary shaft 23 projected from the plug member 22 extends through shaft holes respectively formed at centers of the first oil ring seal 4, the first and the second bearings 3 (or the copper bushings) and projects a free end thereof out of a back side of the second bearing 3 (or copper bushing). A washer 8 is attached to the projected free end of the rotary shaft 23 for holding the same to the bearings 3.

After the plug member 22 and the rotary shaft 23 are fitly assembled with the shaft holder 11 and the bearings 3, the assemblage can be turned upside down to expose the rear oil chamber 5. Lubricant or the like may be filled into the three oil chambers 5, 6, 7 in the shaft holder 11 from the rear oil chamber 5 and then, a second oil ring seal 4 is attached to a back opening of the shaft holder 11 to seal the lubricant or the like in the oil chambers 5, 6, 7.

Figure 3:
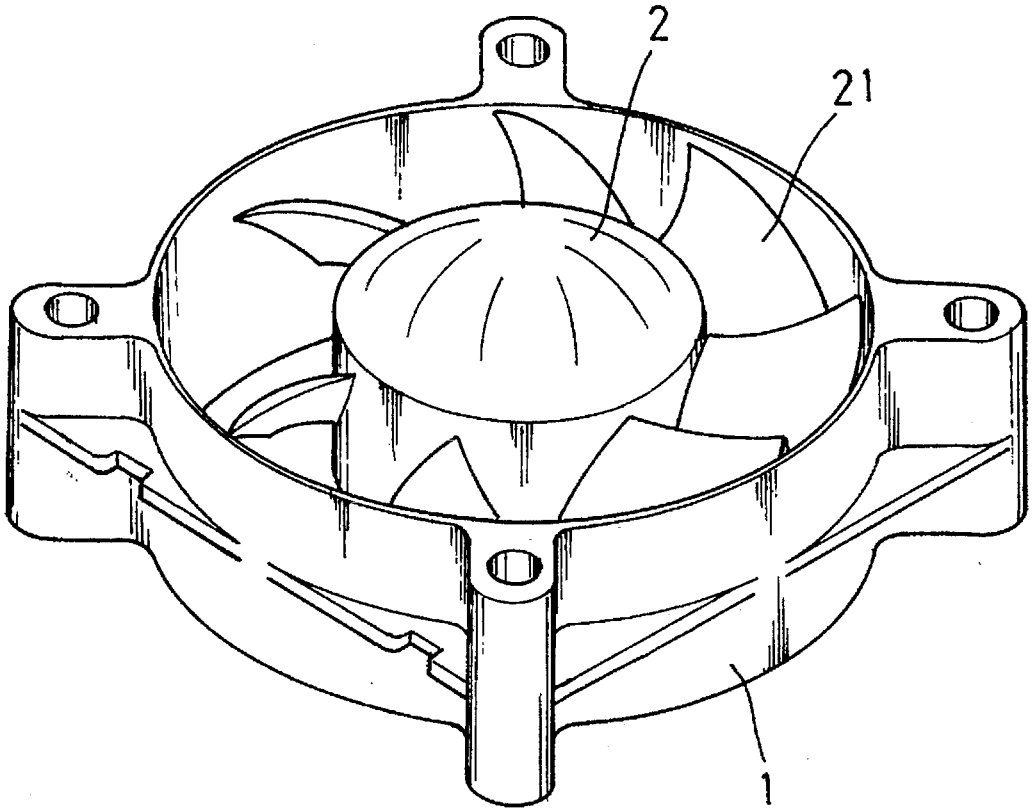
FIG. 3 is an assembled perspective of the present invention.
Figure 4:
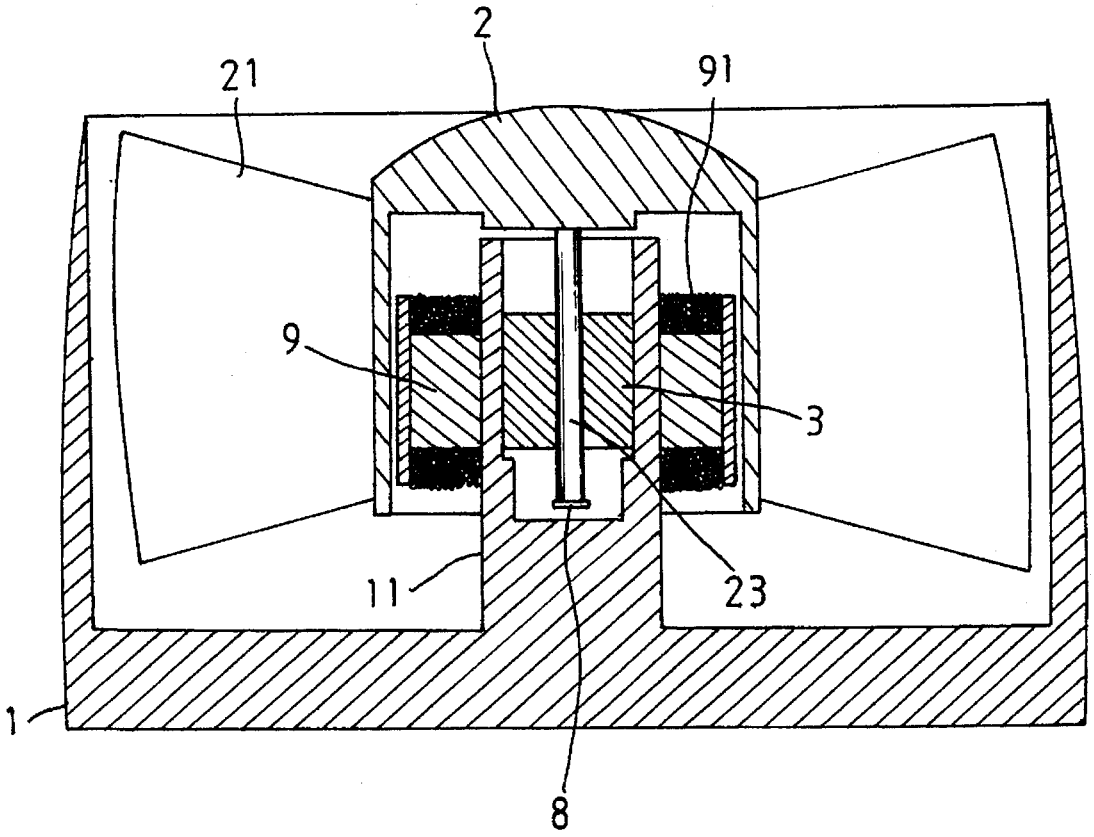
(PRIOR ART) FIG.4
FIG. 4 is sectional view showing a conventional cooling fan for motors.

FIG. 3 illustrates a cooling fan of the present invention assembled from the above-mentioned components and procedures. From the drawing, it can be seen that the cooling fan of the present invention has an appearance substantially similar to that of general cooling fans for motors but has different inner structure which is characterized in the shaft holder 11 having dual bearings 3 or copper bushings and filled with lubricant or the like therein.

With the above-described arrangements, the present invention has improved structure providing the following advantages:

1. The dual bearings 3 or copper bushings enable the rotary shaft 23 to stably rotate in the shaft holder 11 and thereby the possible eccentric rotation of the rotary shaft 23 is completely eliminated.

2. The dual bearings 3 or copper bushings reduce the rotational resistance when the rotary shaft 23 is rotating.

3. The formation of oil chambers 5, 6, and 7, as well as the filling of lubricant or the like in the shaft holder 11 are helpful in reducing the rotational resistance of the rotary shaft 23 and thereby largely reduce the power consumption required by the whole unit. The lubricant in the shaft holder 11 also reduces heat produced by the rotation of the rotary shaft 23 and thereby enhances the cooling effect of the fan.

What is claimed is:

1. A cooling fan for-motors comprising a back cover formed with a through shaft holder at a central portion thereof, said shaft holder having a reduced inner diameter at its middle section and thereby forming a front and a back stepped surfaces at two ends of said diameter-reduced portion for a first and a second bearings to fixedly position in said shaft holder at each side of said reduced middle portion to respectively abut against said stepped surfaces, said shaft holder further having a first oil ring seal fixed to a front opening thereof to close the same, said first oil ring seal and said first and said second bearings together dividing a space defined by said shaft holder into three oil chambers; said cooling fan for motors further comprising a front cover having integrally formed blades for covering over said shaft holder, said front cover having a plug member provided to an inner central portion thereof and a rotary shaft projected from said plug member, said plug member being fitly received in said front opening of said shaft holder while said rotary shaft sequentially extending through said first oil ring seal, said first and said second bearings with a free end of said rotary shaft projecting out of a back side of said second bearing and be held thereto by means of a washer, whereby lubricant or the like is filled into said oil chambers from a back opening of said shaft holder and is stored therein by means of fixing a second oil ring seal to said back opening of said shaft holder.

2. A cooling fan for motors as claimed in claim 1, wherein said rotary shaft is rotatably fixed in place by means of copper bushings.

* * * * *